US008936018B2

(12) United States Patent
Aleardi et al.

(10) Patent No.: US 8,936,018 B2
(45) Date of Patent: Jan. 20, 2015

(54) DEVICE FOR LIGHTING AND CONTROLLING A BURNER IN A HOUSEHOLD APPLIANCE

(75) Inventors: Massimo Aleardi, Cassano (IT); Daniele Pianezze, Cassano (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 1330 days.

(21) Appl. No.: 12/280,075

(22) PCT Filed: Mar. 6, 2007

(86) PCT No.: PCT/IB2007/000529

§ 371 (c)(1), (2), (4) Date: Aug. 20, 2008

(87) PCT Pub. No.: WO2007/102072

PCT Pub. Date: Sep. 13, 2007

(65) Prior Publication Data

US 2010/0043773 A1 Feb. 25, 2010

(30) Foreign Application Priority Data

Mar. 7, 2006 (IT) ..... TO2006A0168

(51) Int. Cl.

| | |
|---|---|
| ***F23N 5/24*** | (2006.01) |
| *F23N 5/12* | (2006.01) |
| *F23D 14/72* | (2006.01) |

(52) U.S. Cl.

CPC ..... *F23N 5/123* (2013.01); *F23N 5/242* (2013.01); *F23N 2027/36* (2013.01);

(Continued)

(58) Field of Classification Search

CPC ..... F23N 2027/36; F23N 2027/02; F23N 2027/28; F23N 2027/30; F23N 5/203; A47J 37/074; A47J 37/0713; A47J 37/0727; F23D 14/06; F23Q 3/006; F23Q 3/008; F24C 3/10; F24C 3/12; F24C 3/085; F24C 3/103; F24C 3/124; F24C 3/126

USPC ..... 126/39 BA, 39 E, 41 R, 42; 431/14

IPC ..... F23B 5/24; F23D 14/72; F23N 5/12

See application file for complete search history.

(56) References Cited

U.S. PATENT DOCUMENTS

| | | | | |
|---|---|---|---|---|
| 31,359 | A * | 2/1861 | Vance | 431/266 |
| 2,449,538 | A * | 9/1948 | Ackerman | 122/504 |

(Continued)

FOREIGN PATENT DOCUMENTS

| | | |
|---|---|---|
| CN | 2273378 Y | 1/1998 |
| DE | 20011457 U | 12/2000 |

(Continued)

OTHER PUBLICATIONS

"MTrans—DE20011457.pdf"; European Patent Office (Machine Translation); Oct. 11, 2011.*

(Continued)

*Primary Examiner* — Kang Hu

*Assistant Examiner* — Daniel E Namay

(74) *Attorney, Agent, or Firm* — Lowe Hauptman & Ham LLP

(57) ABSTRACT

Device including a casing formed by non-conducting material fastenable to the household appliance, electrical supply means and a lighting circuit carried by the casing, and a spark plug fastenable to the household appliance in proximity of burner means carried by the household appliance so as to be electrically connected to earth; the lighting circuit being adapted to supply a high voltage alternating current to said spark plug to make it generate a spark adapted to produce the lighting of a flame following the feeding of a combustible gas flow to the burner means; wherein the supply means are direct current low voltage generator means carried by and accommodated in the casing and supply in parallel said lighting circuit, through ac/dc transformer means, and a control circuit, through electrical disconnection means from the lighting circuit, the control circuit being electrically connected to the spark plug and to a first terminal of a LED indicator fastenable in use to the household appliance and having a second terminal connected to earth, for selectively producing the turning on or off of the LED indicator in consequence of a passage or interruption of a dispersion current to earth which flows in use to the spark plug when the flame is lit.

18 Claims, 3 Drawing Sheets

(52) U.S. Cl.
CPC ..... *F23N 2031/06* (2013.01); *F23N 2031/22* (2013.01); *F23N 2041/08* (2013.01)
USPC ..... 126/39 BA; 126/39 E; 126/41 R; 126/42; 431/14

(56) References Cited

U.S. PATENT DOCUMENTS

| | | | | | |
|---|---|---|---|---|---|
| 2,568,125 | A * | 9/1951 | Jacobs | 361/263 |
| 2,963,624 | A * | 12/1960 | Meyer, Jr. et al. | 315/209 CD |
| 3,546,689 | A * | 12/1970 | Lindberg | 340/596 |
| 3,561,896 | A * | 2/1971 | Riehl | 431/12 |
| 4,024,412 | A * | 5/1977 | MacAskill, Jr. | 307/117 |
| 4,034,270 | A * | 7/1977 | Matthews | 361/256 |
| 4,116,613 | A * | 9/1978 | Matthews | 431/78 |
| 4,474,325 | A * | 10/1984 | Richardson | 237/8 R |
| 4,519,771 | A * | 5/1985 | Six et al. | 431/25 |
| 4,834,644 | A * | 5/1989 | Snow | 431/1 |
| 5,003,960 | A | 4/1991 | Hanagan | |
| 5,236,328 | A * | 8/1993 | Tate et al. | 431/14 |
| 5,575,638 | A * | 11/1996 | Witham et al. | 431/73 |
| 5,617,447 | A * | 4/1997 | Tambe | 373/108 |
| 5,722,823 | A * | 3/1998 | Hodgkiss | 431/43 |
| 5,812,061 | A * | 9/1998 | Simons | 340/815.45 |
| 5,954,265 | A * | 9/1999 | Hall et al. | 236/94 |
| 5,957,679 | A * | 9/1999 | Cacciatore | 431/18 |
| 6,059,479 | A * | 5/2000 | Clune | 403/24 |
| 6,126,435 | A | 10/2000 | Fredin-Garcia et al. | |
| 6,220,854 | B1 * | 4/2001 | Clifford et al. | 431/264 |
| 6,222,719 | B1 * | 4/2001 | Kadah | 361/247 |
| 6,280,180 | B1 | 8/2001 | Fredin-Garcia-Jurado et al. | |
| 6,769,447 | B2 * | 8/2004 | James | 137/66 |
| 6,796,792 | B1 * | 9/2004 | Aleardi et al. | 431/258 |
| 6,923,640 | B2 * | 8/2005 | Canon | 431/72 |
| 7,083,408 | B1 * | 8/2006 | Donnelly | 431/22 |
| 7,150,626 | B2 * | 12/2006 | Clauss et al. | 431/6 |
| 7,255,100 | B2 * | 8/2007 | Repper et al. | 126/39 BA |
| 2002/0073985 | A1 * | 6/2002 | Leukhardt et al. | 126/39 E |
| 2002/0086255 | A1 * | 7/2002 | Chen | 431/51 |
| 2003/0159689 | A1 * | 8/2003 | Huang | 126/39 E |
| 2010/0043773 | A1 * | 2/2010 | Aleardi et al. | 126/39 BA |

FOREIGN PATENT DOCUMENTS

| | | | | | |
|---|---|---|---|---|---|
| EP | 1188989 | A2 | | 3/2002 | |
| GB | 2286038 | A | | 8/1995 | |
| JP | 54049631 | A | * | 4/1979 | F23N 5/12 |
| JP | 54081529 | A | * | 6/1979 | F23Q 3/00 |
| JP | 58055620 | A | * | 4/1983 | F23Q 3/00 |
| JP | 58108328 | A | * | 6/1983 | F23N 5/12 |
| JP | 62108923 | A | * | 5/1987 | F23N 5/12 |
| JP | 06307634 | A | * | 11/1994 | F23N 5/24 |
| WO | WO 2007102072 | A2 | * | 9/2007 | F23N 5/12 |

OTHER PUBLICATIONS

"MTrans—EP1188989.pdf"; European Patent Office (Machine Translation); Oct. 11, 2011.*
ISR for PCT/IB2007/000529 dated Oct. 17, 2007.

* cited by examiner

DEVICE FOR LIGHTING AND CONTROLLING A BURNER IN A HOUSEHOLD APPLIANCE

RELATED APPLICATIONS

The present application is based on International Application Number PCT/IB2007/000529 filed Mar. 6, 2007, and claims priority from Italian Application Number TO2006A000168 filed Mar. 7, 2006, the disclosures of which are hereby incorporated by reference herein in their entirety.

TECHNICAL FIELD

The present invention relates to a device for lighting and controlling a burner in a household appliance, in particular a barbecue range.

BACKGROUND ART

It is known that household appliance provided with burners fed with a combustible gas (e.g. cooking ranges, barbecue ranges, boilers, gas ovens, etc.) are today essentially all provided with manually or automatically controlled electronic lighting devices, acting on each burner or on a flame of a pilot burner, which produces in use the lighting of burners when gas is fed to each one of them.

The known lighting devices are generally supplied by the electrical mains in alternating current and for this reason are cumbersome and non adapted to barbecue ranges, which are generally used in the open (fed by gas, e.g. LPG, cylinders), far away from electrical mains sockets; this problem is overcome by using piezoelectric or battery generators, which however increase the dimensions of the device and/or make it more complex, specifically from the circuital point of view, without adding any essential advantage.

Furthermore, none of the known devices allow to provide a clear and precise indication of the actual lighting status of the burners to the user; consequently, in practice, the user is not able, specifically for uses in the open or however in conditions of burners not in view (barbecue ranges), to understand if the burners of the household appliance are actually on, i.e. whether they are producing a flame (and, for example, the corresponding consequent heating of the food being cooked), or not. The fact the burners are provided with safety, devices based on thermal sensors, which shut off the combustible gas feed (e.g. by means of a solenoid valve or a thermocouple with valve tap) if the flame goes out, does obviously not solve this drawback.

DISCLOSURE OF INVENTION

It is the object of the present invention to avoid the aforesaid drawbacks by providing a lighting and control device for a burner of a household appliance, specifically for a barbecue range, which, in addition to allowing the manual or automatic lighting and relighting of the household appliance burners, also indicates to the user in a clear and visible manner if the flame is lit or not on each burner (or on a pilot lighting burner of the burners).

It is a further object of the invention to provide a lighting and control device of the aforesaid type which is simple, reliable, displays low cost and ensures reduced dimensions.

The present invention thus relates to a device for lighting and controlling the burner of a household appliance as defined in claim 1.

Specifically, the lighting and controlling device according to the invention comprises electrical supply means, a lighting circuit, a casing made of non-conducting material and fastenable in use to the household appliance, carrying the electrical supply means and the lighting circuit, and at least one spark plug electrically connected to the lighting circuit and fastenable to the household appliance in proximity of burner means (the burner to be lit or a pilot lighting burner of the burners) carried by the household appliance so as to be electrically connected to earth, the electrode of the spark plug being immersed in use in the flame.

As in all the known lighting devices, the spark plug is adapted to generate a spark between itself and the burner means to produce the lighting of a flame when the lighting circuit supplies high voltage alternating current, e.g. consequent to the feeding of a flow of combustible gas to the burner means. However, according to the invention the device further comprises a control circuit electrically connected to the spark plug and a light indicator fastenable in use to the household appliance, the control circuit being adapted to selectively turn said indicator on or off in consequence of a flow or interruption of a dispersion current to earth which said control circuit is adapted to make flow to the spark plug exclusively when the flame is lit.

In this manner, it is obtained in a simple, reliable and compact manner, an indication, positive or negative (in the sense that the light indicator may be operated indifferently so as to be on when the flame is lit and off when the flame is absent or on when the flame is absent and off when the flame is lit, in this latter case working as an alarm indicator), of actual lighting of the burner (or pilot burner) controlled by the device itself.

In general, the lighting circuit, the control circuit and the electrical supply means are in use electrically connected together through corresponding contacts carried by the casing and electrically connectable in use to the opposite terminals of a switch controlled by hydraulic feeding means of a combustible gas flow to the burner means.

According to one aspect of the invention, moreover, the electrical supply means are direct current low voltage generator means carried by and accommodated in the casing, which supply in parallel the lighting circuit through ac/dc transformer means and the control circuit through electrical disconnection means from the lighting circuit.

In this manner, the light indicator used is a LED indicator whose first power terminal is connected to the control circuit and whose second power terminal is in use connected to earth through the household appliance itself.

The drawback of needing an electrical mains supply socket or cumbersome piezoelectric generators is thus overcome at the same time by using the necessary additional electrical circuit parts for the supply of the indicator means, specific object of the invention.

BRIEF DESCRIPTION OF THE DRAWINGS

Further features and advantages of the present invention will be apparent in the description that follows of a non-limitative example of embodiment, with reference to the accompanying drawing, in which.

BEST MODE FOR CARRYING OUT THE INVENTION

Figure 1:
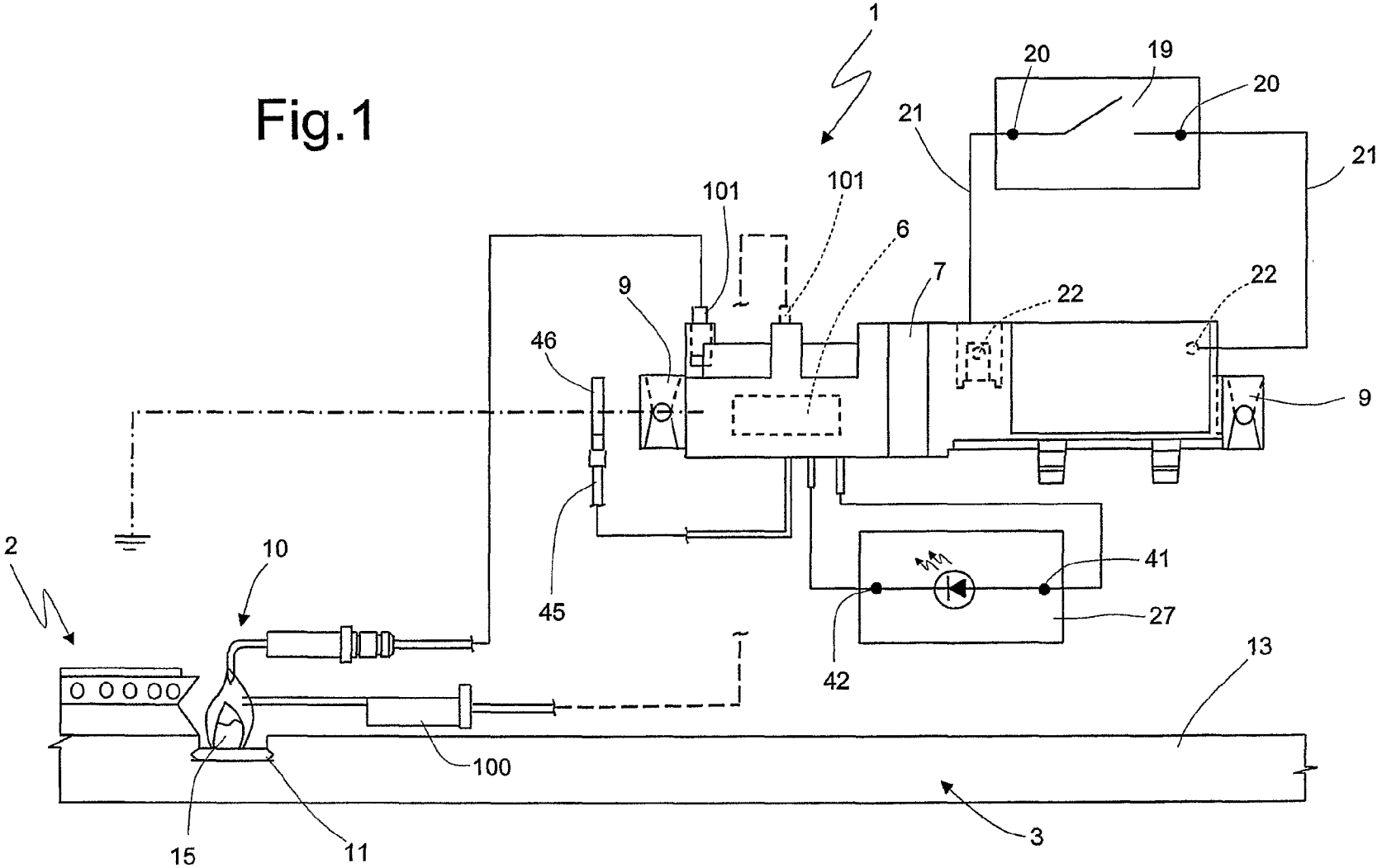
FIG. 1 schematically shows a lighting and control device of a burner of a household appliance made according to the invention.
Figure 5:
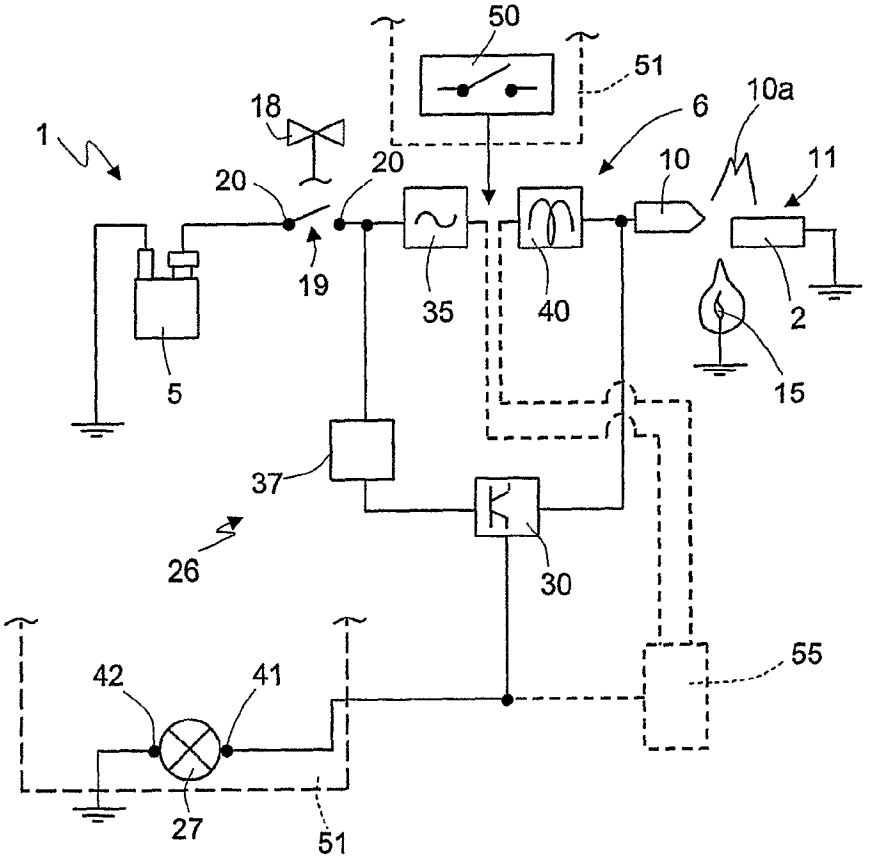
FIG. 5 schematically shows the circuit of FIG. 3 by functional blocks.

With reference specifically to FIGS. 1 and 5, numeral 1 indicates as a whole a lighting and control device of a burner 2 in a household appliance, specifically in a barbecue range 3, of which only the main components are schematically shown for the sake of simplicity in FIG. 1.

Figure 2:
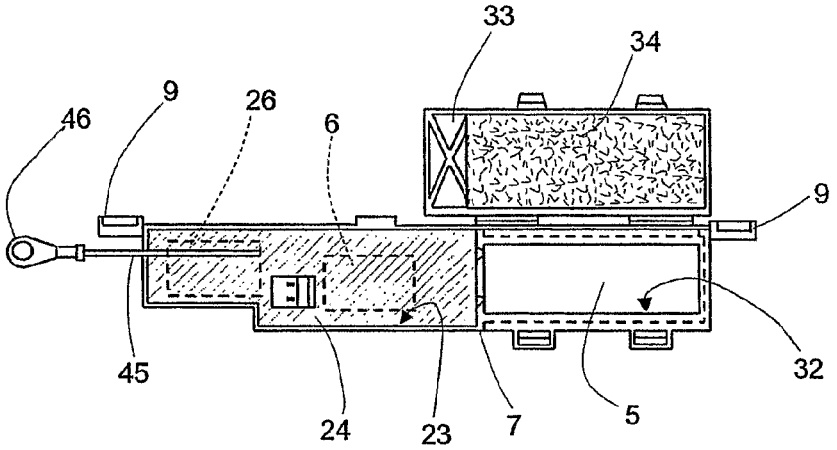
FIG. 2 shows a view turned by 90° of a detail of the device of FIG. 1.

Device 1 is of the type comprising electrical supply means 5 (also see FIGS. 2 and 3), a lighting circuit 6, a casing 7 made of a non-conductive material (e.g. a synthetic plastic material), fastenable in use to household appliance 3, e.g. in a known manner by means of screws (not shown) engaging eyelets 9 in casing 7, and at least one spark plug 10 electrically connected in a known manner to lighting circuit 6 and fastenable to household appliance 3 in a known manner in proximity of burner means 11, which are carried by household appliance 3 so as to be electrically connected to a reference potential, i.e., as indicated for the sake of simplicity hereinafter, "to earth".

In the case in point, such connection to earth is obtained simply through household appliance 3 itself, a supporting structure of which, or "chassis", 13 is metallic and electrically conducting and carries burners 2, spark plug 10 and burner means 11. The latter in the non-limitative case in point shown consist of a pilot burner carried by structure 13, for example next to one (or more) burners 2 to be lit but, according to a possible variant (not shown), may consist directly of burners 2 to be lit. Spark plug 10 is adapted to generate a spark 10*a* (FIG. 5) between itself and burner means 11 (or burner 2) to produce the lighting of a flame 15 when lighting circuit 6 supplies a high voltage alternating current to it consequent to the feeding of a flow of combustible gas (e.g. in the case of a barbecue range, LPG contained in a specific cylinder not shown) to burner means 11 (and to burners 2).

Specifically, the flow of combustible gas to burner means 11 is controlled in a known manner by hydraulic feeding means 18 (FIG. 5) of the combustible gas flow itself to burner means 11, which integrally carry, in a known manner, an electrical switch 19 (FIGS. 1 and 5) provided with opposite terminals 20 connectable in use, by means of electrically conductive wires 21, to corresponding contacts 22 carried by casing 7.

Figure 3:
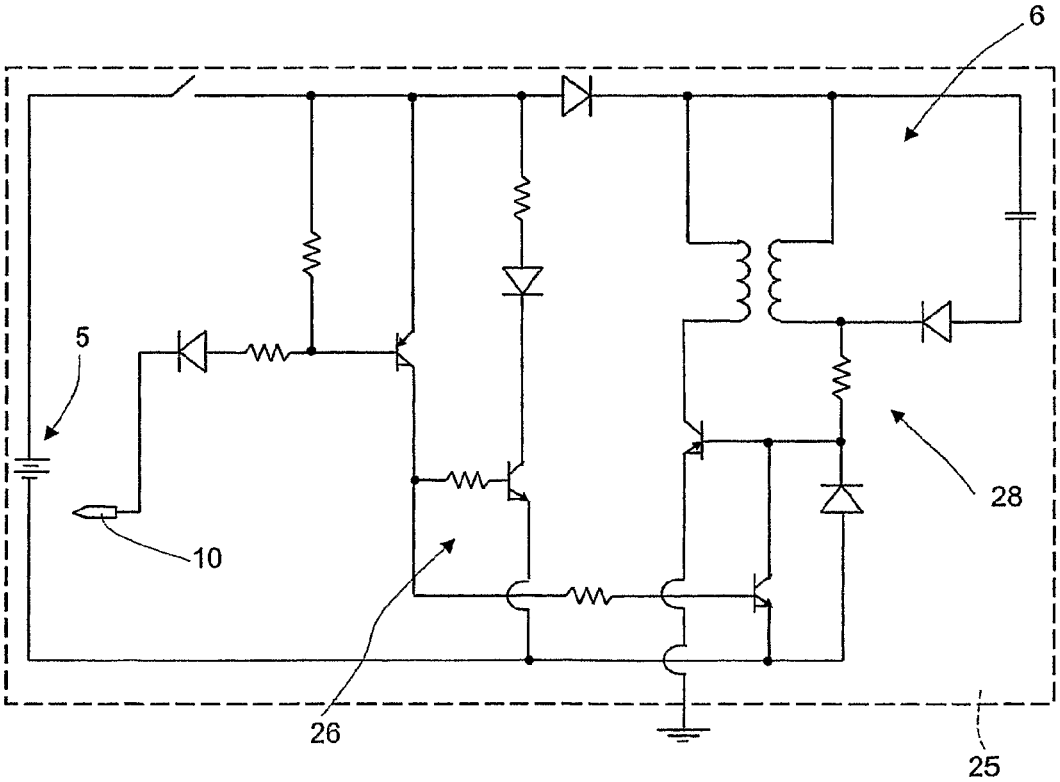
FIG. 3 shows an non-limitative example of practical embodiment of an electrical circuit for the device of FIG. 1.
Figure 4:
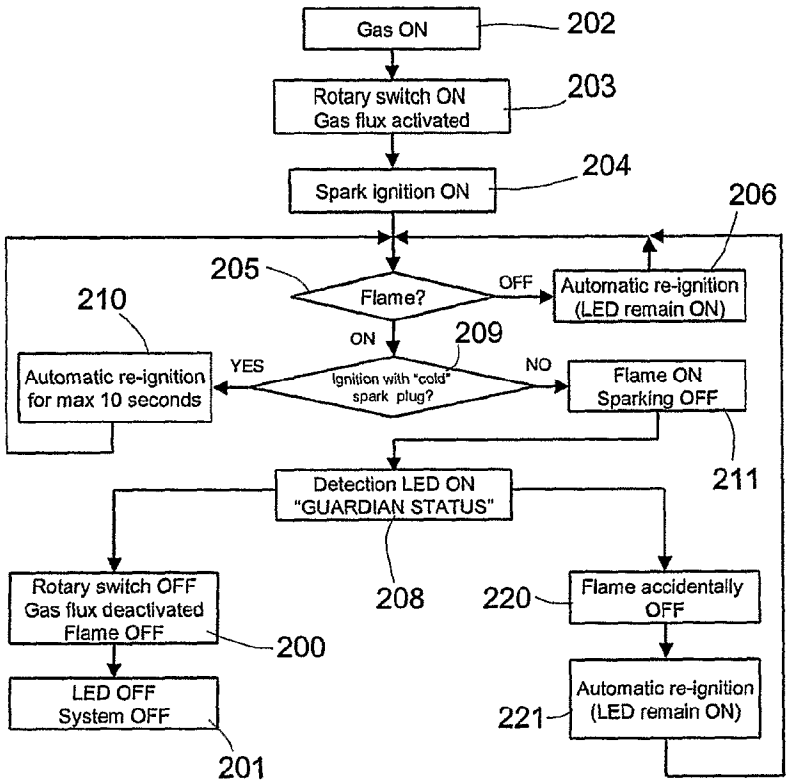
FIG. 4 shows a block diagram of the operation of the device according to the invention.

According to the invention, within casing 7, specifically within a hollow cup-shaped portion 23 filled in use with an insulating resin 24 (FIG. 2), are accommodated (e.g. obtained on one (or more) electronic boards 25—FIG. 3) lighting circuit 6 and control circuit 26 electrically connected to spark plug 10 and to a light indicator 27 fastenable in use to household appliance 3, e.g. onto structure 13; preferably, circuits 6 and 26 are integrated in a single total circuit 28 transferred onto board 25, of the type as that non-limitatively shown in FIG. 3 and whose making is apparent to a person skilled in the art on the basis of description below, specifically with reference to the simplified functional diagram of FIG. 5 and to the block diagram of FIG. 4. Therefore, circuit 28 will not be described in further detail, for the sake of simplicity.

In all cases, control circuit 26 must be made so as to be adapted, according to the invention, to selectively produce either the turning on or off of indicator 27 in consequence of a passage or interruption of a dispersion current to earth (very low, in the order of a few micro ampere) which control circuit 26 is adapted to make flow in use to spark plug 10 exclusively when flame 15 is lit.

In practice, the invention is based on the fact that flame 15, due to the ionisation which is produced in the surrounding air, electrically behaves as a high voltage diode placed in series to a resistor of high order (e.g. of tens of Mega Ω); and on the fact that spark plug 10 appears in use lapped by flame 15 (FIG. 1); therefore, by connecting spark plug 10 to a circuit such as circuit 26, appropriately disconnected (in a known manner apparent to a person skilled in the art) from high voltage circuit 6, it is possible to make a predetermined current, also if extremely small, flow to the same when flame 15 "closes the circuit" to earth, current which, on the contrary, is not produced (because circuit 26 is open) when flame 15 is out (absent); flame 15 is thus made to work as a switch which, in the case in point (FIG. 5), puts into conduction transistor means 30 which, at this point, (according to the diagram shown) put indicator 27 into electrical connection with electrical power source 5. According to this diagram, indicator 27 is on if flame 15 is lit.

It is apparent that according to a possible variant (not shown), it is possible to make circuit 26 so that indicator 27 is supplied only when, on the contrary, flame 15 is absent (out).

In any case, according to a further aspect of the invention, electrical power means 5 are direct current low voltage generators (e.g. formed by a 9V battery) carried by and accommodated within casing 7, in a specific cup-shaped seat 32 fluid-tightly sealable by means of a snappingly closable lid 33 provided with sealing means 34.

In this manner, lighting circuit 6, control circuit 26 and electrical supply means 5 are in use electrically connected together by means of contacts 22 when these are electrically connected, by means of wires 21, to terminals 20 of switch 19, so that battery 5 supplies in parallel lighting circuit 6 through ac/dc transformer means 35, for example of the rectified diode type (FIG. 5), and control circuit 26 through electrical disconnection means 37 (indicated for the sake of simplicity with a block in FIG. 5) from lighting circuit 6; in this manner, control circuit 26 may work at low voltage (e.g. 9 V) and in direct current (dc), under the "direct" supply of battery 5, while circuit 6, otherwise of the known type, is supplied through rectifying diode 35 and a booster coil 40.

In order to advantageously exploit the aforesaid features, light indicator 27 consists of a LED (Light Emitting Diode) indicator a first supply terminal 41 of which is connected to control circuit 26 and a second supply terminal 42 of which is in use connected to earth through household appliance 3 itself, in the case in point through the same general circuit 28 carried by board 25, which is connected to an earth wire 45 protruding from resin 24 and one of whose eyelets 46 is available in use at one of eyelets 9 to be connected to carrying and conductive structure 13 by the screws which fasten casing 7 themselves. It is apparent that, specifically in the case in which casing 7 is fastened to structure 13 through means other than screws and by eyelets 9 (e.g. snappingly), wire 45 is advantageously replaced by another earthing system, for example by means of elastic spring or rigid metallic jumper, to be "imprisoned" between casing 7 and chassis 13 of barbecue 3.

According to a first possibility (of higher simplicity and lower cost), lighting circuit 6 comprises a button switch 50 (of known type) arranged between ac/dc transformer means 35 and booster coil means 40, which button switch 50 is fastenable in use onto household appliance 3, preferably integrated onto a same support 51 with light indicator 27 (FIG. 5).

According to the variant shown with a dotted line in FIG. 5, on the other hand, lighting circuit 6 comprises (instead of switch 50) electronic switching means 55 (e.g. based on transistors) electrically connected in series between ac/dc transforming means 35 and booster coil means 40 and which are carried within casing 7, e.g. integrated in circuit 28, so as to be selectively operated by control circuit 26 in consequence of a passage or interruption of said dispersion current (of a few micro amperes) towards earth that control circuit 26 is adapted to make flow in use towards spark plug 10 exclusively when flame 15 is lit; thus electronic switching means 55 are operated, according to this aspect of the invention, again along with light switch 27 (intending as "operation" of light indicator 27, both its turning on and its turning off).

Although device 1 described may work with one only spark plug 10 for each burning means 11 to be lit, according to a possible variant device 1 (FIG. 1) may comprise a first spark plug 10 and a second spark plug 100 both fastenable to household appliance 3 at burning means 11 electrically connected to earth; first spark plug 10 will in this case be electrically connected only to lighting circuit 6, for the sole purpose of generating spark 10*a*; while second spark plug 100 will be electrically connected only to control circuit 26, so as to serve exclusively as flame sensor, i.e. as electrical connection "bridge" between flame 15 and circuit 26 in order to allow the flow to earth of the above-mentioned dispersion current of several micro amperes.

Finally, on the basis of the description, it is apparent that, if device 1 comprises one spark plug 10 (and possibly an additional spark plug 100) for each burner 2, whereas burner means 11 consist of burners 2 themselves, lighting circuit 6 will comprise a plurality of high voltage output contacts 101 (FIG. 1) carried by casing 7, each of which will be connectable in use to a corresponding spark plug 10 through wires of appropriate length.

On the other hand, in the case in which lighting and control device 1 comprises one only spark plug 10, plus only one possible additional spark plug 100, this/these will be arranged at a pilot burner 11 for lighting all burners 2 of household appliance 3.

On the basis of the description, it is apparent that, with the use of electronic means of common use, such as transistors, diodes, capacitors and resistors (i.e. with necessarily the use of microprocessors), it is possible to implement at low cost, by means of circuit 28, the block diagram of FIG. 4 (which refers to the more complex case of the presence of electronic switching means 55).

When hydraulic control means 18, these being either one single tap per burner 2 or a general supply valve for pilot burner 11 and burners 2, in turn controlled by single taps (not shown) arranged downstream of hydraulic control means 18, are closed (off), switch 19 is open and therefore (blocks 200 and 201–FIG. 4) there is no flow of gas, there is no flame 15 and LED 27 is off (all device 1 is off).

On the other hand, when hydraulic control means are on (open), switch 19 is closed and circuits 6 and 26 are supplied (blocks 202, 203—FIG. 4).

In the presence of manual switch 50, for producing the lighting of burner means 11 (burners 2) it is necessary to press button switch 50 to close it and supply current to circuit 6, generating sparks 10*a* which trigger the lighting of flame 15 (block 204); during such step the aforesaid dispersion current to earth passes intermittently in circuit 26 (because sparks 10*a* are intermittent since circuit 6 is supplied by half-waves) through spark plug 10 and LED 27 consequently blinks, but does not light up; when flame 15 is stabilised, on the other hand, LED 27 stops blinking and the user shall be informed that button 50 may be released (flame 15 on); if flame 15 accidentally goes out (e.g. due to a gust of wind or because it gets wet), LED 27 goes off, informing the user that flame 15 must be re-lit by pressing switch 50 again (obviously, in addition to the lighting of LED 27 in this case it may be contemplated that circuit 26 further comprises an alarm buzzer, which at this point would be operated (switched on, until either button 50 is pressed or switch 19 is open).

In the case of presence of electronic switch 55, on the other hand, the lighting of burner means 11 (burners 2) is produced automatically as soon as switch 19 is closed; indeed, battery 5 supplies in such case current to circuit 26 which, in absence of flame 15 (no dispersion current to earth) operates electronic switching means 55 to generate sparks 10*a*; in such step (blocks 205, 206) LED 27 blinks but does not light up. At this point, as soon as flame 15 is on, the above-mentioned dispersion current starts passing to earth which closes through flame 15 itself and thus LED 17 is on (block 208).

It is possible at this step, by means of an appropriate branch of circuit 28, also to implement blocks 209, 210, 211, according to which, if spark plug 10 is still cold (condition of flame 15 just lit), for which displays a different electrical resistance with respect to warm, circuit 26 operates switching means 55 again for a certain time continuing the generation of sparks (e.g. for 10 seconds), for safety reasons, to then definitively deactivate circuit 6 interrupting the generation of sparks 10*a*.

In these conditions, the system is in stand-by or "monitoring" status, indicated by the steady lighting (in the example shown) of LED 27. If flame 15 goes out, dispersion current to earth to spark plug 10 immediately ceases and circuit 26 consequently produces a new activation of switching means 55 (blocks 220, 221) to produce the generation of sparks 10*a* again. LED 27 blinks during such step.

The invention claimed is:

1. A device for lighting and controlling a burner in a household appliance, the device comprising:

an electrical supply unit;

a lighting circuit;

a casing made of non-conducting material and fastenable in use to the household appliance, said casing carrying said electrical supply unit and said lighting circuit;

at least one spark plug electrically connected to said lighting circuit and fastenable to the household appliance in proximity of a burner unit carried by the household appliance so as to be electrically connected to a reference potential, the spark plug being adapted to generate a spark between itself and the burner unit to ignite a flame when said lighting circuit is powered by a high voltage alternating current consequent to a feeding of a flow of combustible gas to said burner unit;

a light indicator; and a control circuit electrically connected to said spark plug and the light indicator, the light indicator fastenable in use to the household appliance, wherein the control circuit is adapted to selectively turn said light indicator on or off based on a dispersion current flowing through the spark plug to the reference potential when the burner unit is lit, the dispersion current being in an order of a few microamperes, said electrical supply unit is a direct current low voltage generator unit accommodated in the casing, and said electrical supply unit is adapted to supply power, in parallel, to said lighting circuit through a dc/ac transformer unit and to said control circuit through an electrical disconnection unit.

2. The device according to claim 1, wherein said lighting circuit, control circuit and electrical supply unit are in use electrically connected together through respective contacts carried by said casing and electrically connectable in use to opposite terminals of a switch, and the switch is controlled by a hydraulic feeding unit to control said flow of combustible gas to said burner unit.

3. The device according to claim 1, wherein said light indicator is a LED indicator having a first power terminal connected to said control circuit and a second power terminal, in use, connected to ground through said household appliance.

4. The device according to claim 1, wherein said lighting circuit comprises a button switch arranged between said dc/ac transformer unit and a booster coil unit, the button switch being fastenable in use onto the household appliance.

5. The device according to claim 1, wherein said lighting circuit comprises an electronic switching unit electrically connected in series between said dc/ac transformer unit and booster coil unit;

carried inside said casing; and selectively operated by said control circuit in consequence of the flow or interruption of the dispersion current to ground; said control circuit being adapted to be enabled by the flow of the dispersion current in use towards said spark plug and to enable the light indicator exclusively when said flame is present.

6. The device according to claim 1, wherein the at least one spark plug comprises a first spark plug and a second spark plug both fastenable to the household appliance in proximity of the burner unit carried by the household appliance so as to be electrically connected to ground;

the first spark plug being electrically connected to said lighting circuit; and the second spark plug being electrically connected exclusively to said control circuit, so as to serve exclusively as a flame sensor.

7. A household appliance comprising a lighting and control device according to claim 1, at least one spark plug for each range;

said lighting circuit including a plurality of high voltage output contacts carried by said casing, each of which is connectable in use to a respective spark plug through wires.

8. A household appliance comprising a lighting and control device according to claim 1, wherein said at least one spark plug is arranged at a pilot burner to light all the burners of the household appliance.

9. The device according to claim 4, wherein the button switch is integrated on the same support as said light indicator.

10. The device according to claim 1, wherein the reference potential is a ground potential.

11. A device, comprising:

an apparatus configured to light and control a burner in a household appliance, the apparatus including:

an electrical supply unit;

a lighting circuit;

a casing made of non-conducting material and fastenable in use to the household appliance, said casing carrying said electrical supply unit and said lighting circuit;

at least one spark plug electrically connected to said lighting circuit and fastenable to the household appliance in proximity of a burner unit carried by the household appliance so as to be electrically connected to a reference potential, the spark plug being adapted to generate a spark between itself and the burner unit to ignite a flame when said lighting circuit is powered by a high voltage alternating current consequent to a feeding of a flow of combustible gas to said burner unit;

a light indicator; and a control circuit electrically connected to said spark plug and the light indicator, the light indicator fastenable in use to the household appliance, wherein the control circuit is adapted to selectively turn said light indicator on or off based on a dispersion current flowing through the spark plug to the reference potential when the burner unit is lit, said electrical supply unit is a direct current low voltage generator unit accommodated in the casing, and said electrical supply unit is adapted to supply power, in parallel, to said lighting circuit through a dc/ac transformer unit and to said control circuit through an electrical disconnection unit.

12. The device according to claim 11, wherein the reference potential is a ground potential.

13. The device according to claim 11, wherein the dispersion current being in an order of a few microamperes.

14. The device according to claim 11, wherein the device further includes the household appliance in which there is the burner, and wherein the apparatus is in communication with the burner to light and control the burner.

15. The device according to claim 1, wherein the device further includes the household appliance in which there is the burner, and wherein the apparatus is in communication with the burner to light and control the burner.

16. The device according to claim 1, wherein the direct current low voltage generator unit is a 9 volt battery.

17. The device according to claim 11, wherein the direct current low voltage generator unit is a 9 volt battery.

18. A device, comprising:

an means for lighting and controlling a burner in a household appliance, the apparatus including:

a means for supplying electricity;

a lighting circuit;

a means for carrying said means for supplying electricity and said lighting circuit, said means for carrying being fastenable in use to the household appliance;

a means for generating a spark between itself and a burner unit to ignite a flame when said lighting circuit is powered by a high voltage alternating current consequent to a feeding of a flow of combustible gas to the burner unit, the means for generating a spark being electrically connected to said lighting circuit and fastenable to the household appliance in proximity of the burner unit, which is carried by the household appliance, so as to be electrically connected to a reference potential;

a means for indicating lighting; and a control circuit electrically connected to said means for generating a spark and the means for indicating lighting, the means for indicating lighting being fastenable in use to the household appliance, wherein the control circuit is adapted to selectively turn said means for indicating lighting on or off based on a dispersion current flowing through the means for generating a spark to the reference potential when the burner unit is lit, said means for supplying electricity is accommodated in the casing, and said means for supplying electricity is adapted to supply power, in parallel, to said lighting circuit through a dc/ac transformer unit and to said control circuit through an electrical disconnection unit.

* * * * *